US011618993B2

(12) United States Patent
Saudi et al.

(10) Patent No.: US 11,618,993 B2
(45) Date of Patent: Apr. 4, 2023

(54) WIDTH-FOLDING SYSTEM AND METHOD FOR CREATING WIDTH-FOLDS IN AN ARTICLE OF LAUNDRY

(71) Applicant: MIELE & CIE. KG, Gütersloh (DE)

(72) Inventors: Bilal Saudi, Taibe (IL); Isaac Naor, Hod Hasharon (IL); Alon Naim, Rosh-HaAyin (IL)

(73) Assignee: MIELE & CIE. KG, Gutersloh (DE)

( * ) Notice: Subject to any disclaimer, the term of this patent is extended or adjusted under 35 U.S.C. 154(b) by 105 days.

(21) Appl. No.: 17/291,518

(22) PCT Filed: Dec. 23, 2019

(86) PCT No.: PCT/IL2019/051397
§ 371 (c)(1),
(2) Date: May 5, 2021

(87) PCT Pub. No.: WO2020/141506
PCT Pub. Date: Jul. 9, 2020

(65) Prior Publication Data

US 2022/0002935 A1 Jan. 6, 2022

Related U.S. Application Data

(60) Provisional application No. 62/786,440, filed on Dec. 30, 2018.

(51) Int. Cl.
*D06F 89/00* (2006.01)
*D06F 89/02* (2006.01)

(52) U.S. Cl.
CPC ..... *D06F 89/023* (2013.01); *D06F 89/00* (2013.01)

(58) Field of Classification Search
CPC ..... D05B 35/00; D05B 35/10
See application file for complete search history.

(56) References Cited

U.S. PATENT DOCUMENTS 560,296 A * 5/1896 Levy ..... D05B 35/06 112/152
1,723,543 A * 8/1929 De Santis ..... D06J 1/00 223/37

(Continued)

FOREIGN PATENT DOCUMENTS

CN 206941265 U 1/2018

OTHER PUBLICATIONS

Techcrunch: "Foldimate laundry folding robot—You Tube". Retrieved Feb. 28, 2020 from: https://web.archive.org/web/2018082820 1724/ https://www.youtube.com/watch?v=C76os XtpleM; [n.b. minute 0:43].

(Continued)

*Primary Examiner* — Ismael Izaguirre
(74) *Attorney, Agent, or Firm* — The Roy Gross Law Firm, LLC; Roy Gross

(57) ABSTRACT

A width folder is configured for width-folding an article of laundry, and especially lateral excess portions thereof. The width folder includes male and female members stacked along a vertical direction. The male member includes two opposite first folding edges which extend along a laundry article motion direction perpendicular to the vertical direction and further includes opposite male top and bottom surfaces each of which extends between the first folding edges. The female member being located at least partially beneath the male member and includes two opposite second folding edges which converge in the motion direction. The female member further includes opposite female top and bottom surfaces. The female member further includes opposite folding protrusions which extend outwardly therefrom in a direction away from the female top surface.

13 Claims, 3 Drawing Sheets

(56) References Cited

U.S. PATENT DOCUMENTS

| | | | | | |
|---|---|---|---|---|---|
| 2,313,261 | A | * | 3/1943 | Podgorny | D05B 35/062 112/152 |
| 2,715,376 | A | * | 8/1955 | Hengstler | D05B 35/02 112/147 |
| 3,216,384 | A | * | 11/1965 | Sigoda | D05B 1/24 112/140 |
| 3,534,954 | A | * | 10/1970 | Lynch, Jr. | B65H 45/101 112/141 |
| 3,642,270 | A | * | 2/1972 | Patton, Jr. | D06F 89/00 493/457 |
| 3,774,903 | A | * | 11/1973 | Sjoman | B65B 25/20 493/428 |
| 4,614,512 | A | * | 9/1986 | Capdeboscq | B31B 50/36 198/405 |
| 5,800,329 | A | * | 9/1998 | Fager | B31B 50/58 493/422 |

OTHER PUBLICATIONS

"Beterrific: FOLDIMATE Laundry Folding Machine at CES 2019!—YouTube". Retrieved Feb. 28, 2020 from: https://web.archive.org/web/2019081304 3734/https://www.youtube.com/watch?v=2kv9eeKqmNk [n.b. minute 2:21].

PCT International Search Report for International Application No. PCT/IL2019/051397, dated Mar. 19, 2020, 4pp.

PCT Written Opinion for International Application No. PCT/IL2019/051397, dated Mar. 19, 2020, 6pp.

PCT International Preliminary Report on Patentability for International Application No. PCT/IL2019/051397, completed Mar. 19, 2020, 7pp.

* cited by examiner

WIDTH-FOLDING SYSTEM AND METHOD FOR CREATING WIDTH-FOLDS IN AN ARTICLE OF LAUNDRY

This application is a National Phase of PCT Patent Application No. PCT/IL2019/051397 having International filing date of Dec. 23, 2019, which claims the benefit of priority of U.S. Provisional Patent Application No. 62/786,440, filed Dec. 30, 2018, the contents of which are all incorporated herein by reference in their entirety.

FIELD OF THE INVENTION

The subject matter of the current application relates to folding machines configured for folding articles of laundry. Specifically, it relates to width-folding mechanisms configured for passively performing width-folds in articles of laundry and for handling excess fabric in wide articles or articles with wide, bulging or stiff extremities.

SUMMARY OF THE INVENTION

In accordance with a first aspect according to the subject matter of the present application there is provided a width-folding system, or width folder, configured for folding an article of laundry, and especially excess portions thereof, the width folder comprising male and female members stacked along a vertical direction;

the male member comprising two opposite first folding edges extending along a laundry article motion direction perpendicular to the vertical direction and comprising opposite male top and bottom surfaces each extending between the first folding edges; and the female member being located at least partially beneath the male member and comprising two opposite second folding edges converging in the motion direction; the female member further comprising opposite female top and bottom surfaces; in a plan view of the width folder along the vertical direction, each second folding edge intersecting a respective adjacent first folding edge;

wherein the female member further comprises opposite folding protrusions which extend outwardly therefrom in a direction away from the female top surface and configured to urge inwards, in the width-direction (WD), extremities, or excess fabric, of the laundry articles while these proceed across the male top surface.

In accordance with a second aspect according to the subject matter of the present application there is provided a method of width-folding excess portions of an article of laundry comprising the following steps:

a. providing the width folder;

b. Pulling the article on top of the male member in the motion direction while the extremities of the article hang respectively over the first folding edges, until two folds are created, one on each side of the article.

Any of the following features, either alone or in combination, may be applicable to any of the above aspects of the subject matter of the application:

The male member can further comprise a sloping portion extending downwards, beneath the male top surface, along the vertical direction, and in a direction opposite the motion direction.

The male and female members are preferably permanently and rigidly connected to one another.

The folding protrusions can have a rectilinear blade shape in a view along a width direction which is perpendicular to the motion direction and to the vertical direction.

The folding protrusions can have a thin shape which extends parallel to the vertical direction.

The folding protrusions preferably extend beyond the male member in the vertical direction away from the female top surface.

The folding protrusions extend from the female top surface.

Each folding protrusion extends from a respective end of the respective female folding edges.

The width folder can have exactly two folding protrusions.

In a top view of the width folder, tangent lines to each of the first folding edges converge in a direction opposite the motion direction.

The male top surface can include two parallel grooves, or recesses which open out thereto.

In a bottom view of the width folder, tangent lines to each of the second folding edges converge in the motion direction.

Each second folding edge can include a folding edge recess for long sleeves which is configured for improved fold formation, locating the sleeves, repeatability and consistency.

BRIEF DESCRIPTION OF THE DRAWINGS

For a better understanding of the subject matter of the present application and to show how the same may be carried out in practice, reference will now be made to the accompanying drawings, in which.

DETAILED DESCRIPTION OF THE INVENTION

In the following description, various aspects of the subject matter of the present application will be described. For purposes of explanation, specific configurations and details are set forth in sufficient detail to provide a thorough understanding of the subject matter of the present application. However, it will also be apparent to one skilled in the art that the subject matter of the present application can be practiced without some specific configurations and details presented herein.

Figure 1:
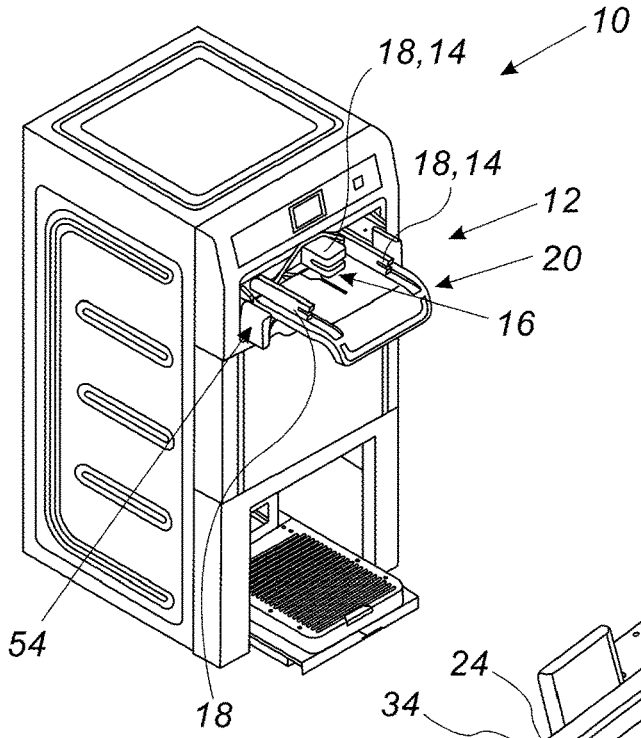
FIG. 1 is an isometric view of a folding machine for folding articles of laundry which includes a width folder.

Reference is made to FIG. 1. An article folding machine 10 includes an article feeding, or loading system 12. The loading system 12 includes a pulling mechanism 14 which includes a hanger 16 with article clips 18 and a width folder 20. A user feeds, or places an article 58 in the hanger clips 18 which grab and hold the article 58 and the pulling mechanism 14 pulls the article 58 into the folding machine 10 and preferably onto a conveyor located inwardly within the folding machine 10. The width folder 20 can be stationary, dismantlable or retractable, in the sense that it can be folded, or inserted, inwardly into the folding machine 10, e.g., during storage, and can extend outwardly away from the folding machine 10 during an operative state.

The inwards direction in which the article 58 is pulled, the width folder 20 and the conveyor define a conveyance direction, or an article motion direction MD. A width direction WD is defined perpendicular to the motion direction MD. A vertical direction VD is defined perpendicular to the motion direction MD and perpendicular to the width direction WD.

The pulling mechanism 14 is located at least at the same height, and preferably above, the width folder 20 in the vertical direction VD, and the width folder 20 is preferably located in front of, or before the conveyor, which is configured to further convey articles 58 into the folding machine 10 once the pulling mechanism 14 has released the article 58. In accordance with some embodiments, the pulling mechanism 14, and specifically the clips 18, are located in dedicated grooves 24, or recesses, in the width folder 20, as will be further explained below.

According to some embodiments, the width folder 20 can have a fixed width along a direction parallel to the width direction WD.

Figure 2:
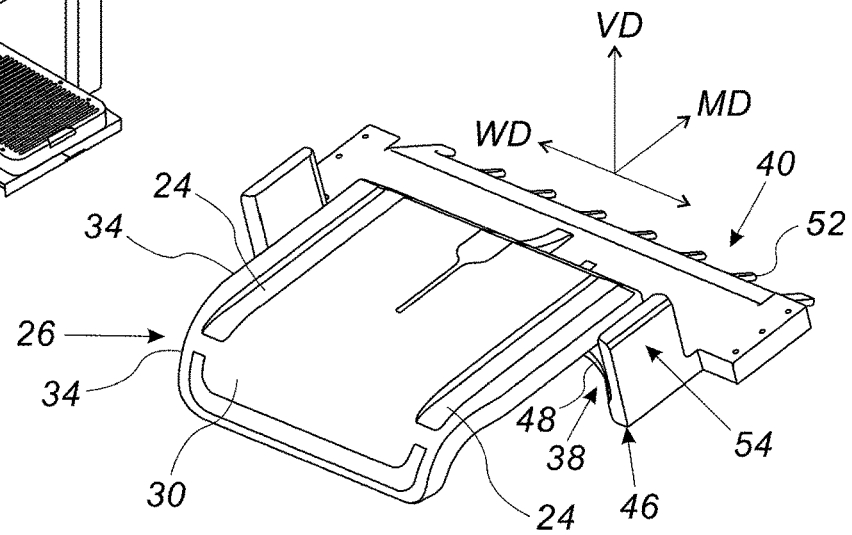
FIG. 2 is an isometric view of the width folder of FIG. 1 which includes a male member and a female member, both configured to perform two width folds in a laundry article.
Figure 3:
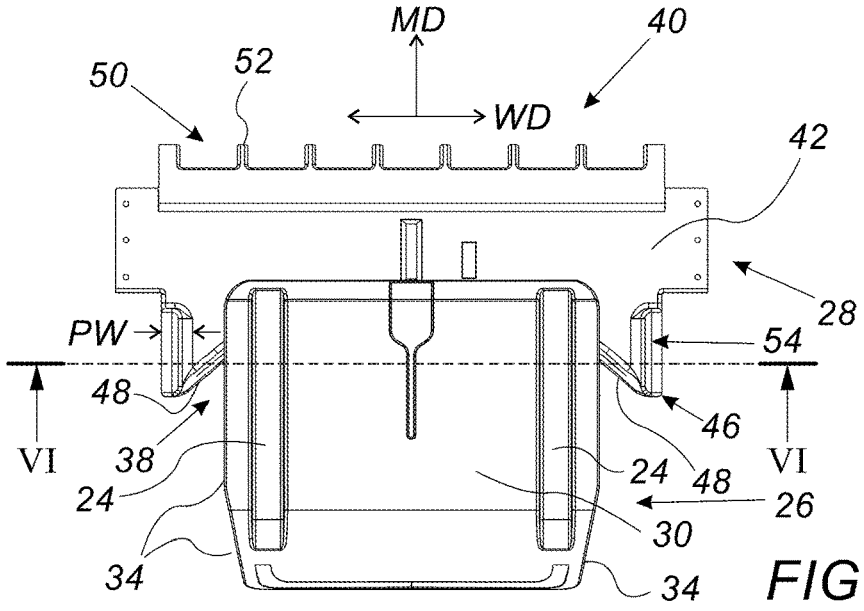
FIG. 3 is a top, plan view of the width folder of FIG. 2.

Attention is drawn to FIGS. 2-3. The width folder 20 is a passive, or a semi-passive, mechanism. The word passive is used herein in the sense that describes the stationary, or rigid state of the width folder 20 during the folding operation. It is rather the fabric that is 'active', and pulled by the pulling mechanism 14 thereacross (or therethrough) in the motion direction MD for the width folder 20 to passively create the folds.

Figure 4:
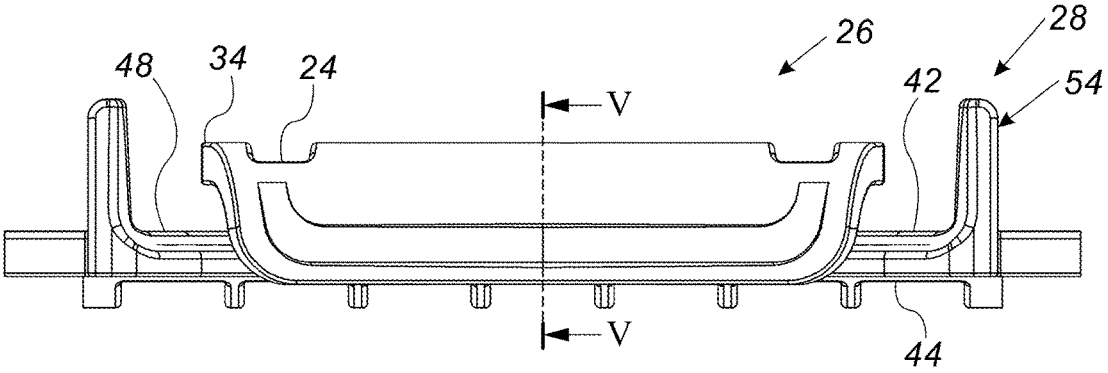
FIG. 4 is a front view of the width folder of FIG. 2 taken along a motion direction.
Figure 5:
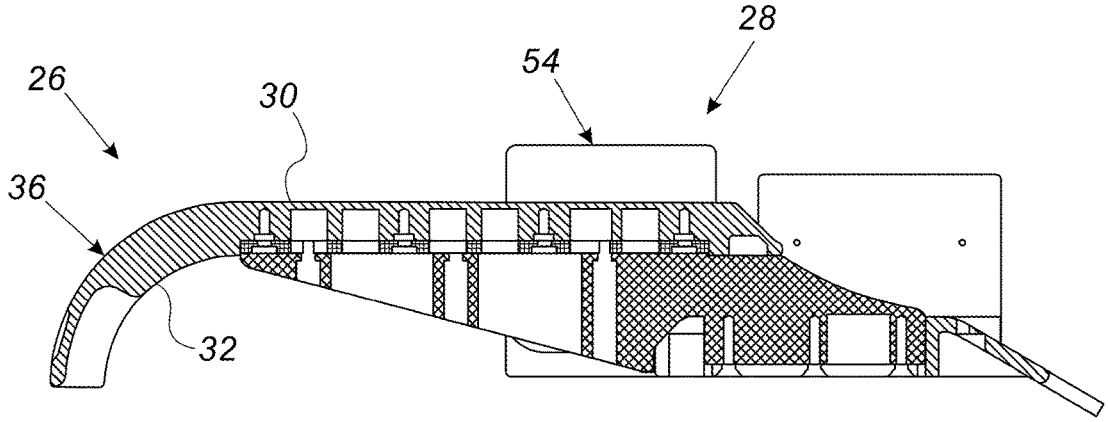
FIG. 5 is a cross-sectional view of the width folder of FIG. 2 taken along line V-V of FIG. 4.
Figure 6:
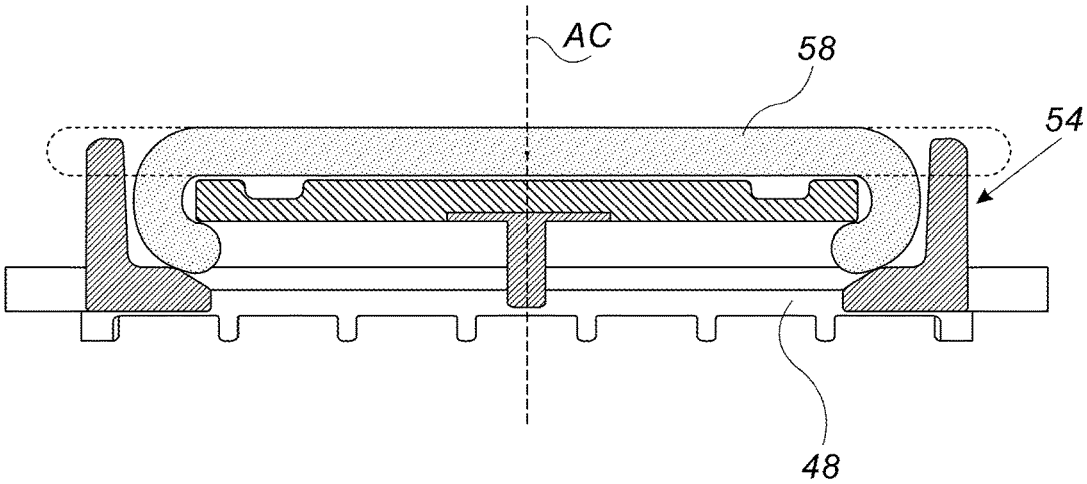
FIG. 6 is a cross-sectional taken along line VI-VI of FIG. 3 showing the width folder of FIG. 2 while utilizing two specialized protrusions to fold a stiff, or bulky, article of laundry; plus, an illustration of the same article (dashed line) in a scenario where the width folder lacks the two protrusions required to fold such articles.

Attention is drawn to FIGS. 4-6. The width folder 20 is configured to perform, or create, a single width-fold on each side of an article plane AC in which the motion direction MD and the vertical direction VD extend and intersect. According to the present embodiment, the width folder 20 includes two members stacked in the vertical direction VD—a male member 26 and a female member 28 located thereunder.

The male member 26 has male top and bottom surfaces 30, 32 and opposite first folding edges 34. The male member 26 can have a unitary, one-piece construction. Both first folding edges 34 are preferably mostly parallel, or generally parallel within tolerances (deviations of about 2 degrees), and each is configured to define a first fold in the article 58. The male member 26 includes a slope, or bend 36 in the motion direction MD (forming a downwards-facing slope or convexity in the male member 26) such that adjacent the bend 36, the male member 26 extends downwards along the vertical direction VD. In a top view of the male top surface 30, or along the vertical direction VD, the first folding edges 34, or at least tangent lines thereto, can converge towards each other opposite the motion direction MD, i.e., when proceeding outwards from the folding machine 10. The male top surface 30 can include two parallel grooves 24, or recesses, which open out thereto. The grooves 24 are non-essential, but efficient to allow portions of the pulling mechanism 14 to pull the articles 58 along the male top surface 30 with minimum, or no gaps between the articles 58 and the male top surface 30. In the absence of such grooves 24, the pulling mechanism 14 would hold the article's edge slightly higher, separated from the male top surface 30, creating said gap, which could lower folding quality and consistency. Furthermore, experimentation shows that users sometime mistakenly tried to feed the item in the gap between the feeder and the top surface (below the feeder). Plus, as a consequence of lowering the pulling mechanism 14 into the male top surface 30, the article 58 has a smaller distance to drop after released from the pulling mechanism 14, thus lowering the chance for unfolding after being folded by the width folder 20.

Attention is again drawn to FIG. 3. The female member 28 has opposite female front and rear portions 38, 40, each of which extends between opposite female top and bottom surfaces 42, 44. The female member 28 includes two opposite female extensions 46 which form an opening therebetween. Each of the two female extensions 46 includes an internal, second folding edge 48 which faces another second folding edge 48 of the opposite female extension 46. In a top view of the female member 28, the two second folding edges 48, or at least tangent lines thereto, converge towards each other when proceeding in the motion direction MD.

The female rear portion 40 can include a conveyor transition adapter 50. The conveyor transition adapter 50 has adapter protrusions 52 which are configured to prevent the folded article 58 from becoming entangled and/or getting stuck between conveyor belts of the conveyor located in the motion direction MD adjacent the female member 28. Furthermore, the adapter protrusions 52 prevent adjacent conveyor belts from overlapping, i.e., climbing on top of each other. The adapter protrusions 52 are elongated, finger-shaped extensions which extend from the conveyor transition adapter 50. The adapter protrusions 52 can extend both in the motion direction MD and downwards in the vertical direction VD. Each adapter protrusion 52 is configured to fit in between two conveyor belts, thus preventing the article 58 folded by the width folder 20 from entering between the conveyor belts.

The female member 28 further includes folding protrusions 54 which extend outwardly therefrom in a direction away from the female top surface 42 and configured to perform an excess-fold for, and/or induce convergence of, excess fabric of articles 58 when they are pulled across the male top surface 30 and onto the width folder 20.

Each folding protrusion 54 can have a rectilinear blade, or fin, shape. In other words, the folding protrusions 54 can have a thin design. Specifically, the folding protrusion 54 has a protrusion width PW, measured along the width direction WD, which is smaller than any of the dimensions of the folding protrusion 54 which are measured in either the vertical or motion directions VD, MD.

As seen in FIG. 3, in a top, plan view of the width folder 20, or in a view along the vertical direction VD, the folding protrusions 54 can have an elongated shape which extends parallel to the motion direction MD. The folding protrusions 54 are designed and configured to 'pick up', and induce convergence of any excess fabric portion which did not enter, or was pulled, above the male member 26 and/or between the male member 26 and the female member 28. In FIG. 6, it is illustrated how a cross-section of an article 58 with rather short, but stiff, extremities would look like, with respect to the width folder 20, if it had no folding protrusions 54 (dashed line). In the same view, it is also illustrated how the same article is properly folded in a width folder 20 that does include the folding protrusions 54.

Each folding protrusion 54 can extend from the female top surface 42 beyond the male member 26 in the vertical direction (VD) away from the female top surface 42.

Each folding protrusion 54 preferably extends from an entrance end of a respective second folding edge 48. Specifically, each folding protrusion 54 can meet the second folding edge 48 at the extremity of the female member 28. According to the present embodiment, the width-folder 20 comprises exactly two folding protrusions 54.

In the top view of the width folder 20, it is seen that at an entrance end thereof, the two first folding edges 34 are located between the two second folding edges 48 in the width direction WD, such that when an article 58 is pulled across the male member 26 in the motion direction MD, a mid-portion of the article 58 climbs onto the male member 26 and any excess fabric at each side of the male member 26, hangs downwards and, in most cases, is located between each adjacent first and second folding edges 34, 48. Attention is drawn to FIG. 6 or 9. When the article 58 is pulled further in the motion direction MD, due to the inwards convergence of the second folding edges 48, these portions of excess fabric are urged, or folded (folds are therefore first created both at, and by, the first folding edges 34), beneath the male member 26 and across the first folding edges 34. However, in cases where the laundry article 58 is too wide, bulging, or stiff, without the folding protrusions 54, these extremities of the article 58 can proceed outside of, or above, the female member 28 and out of the reach of the second folding edges 48. In these cases, the folding protrusions 54 are configured to prevent this from happening, and force the excess fabric to converge by forcing it back towards the second folding edges 48.

Figure 7:
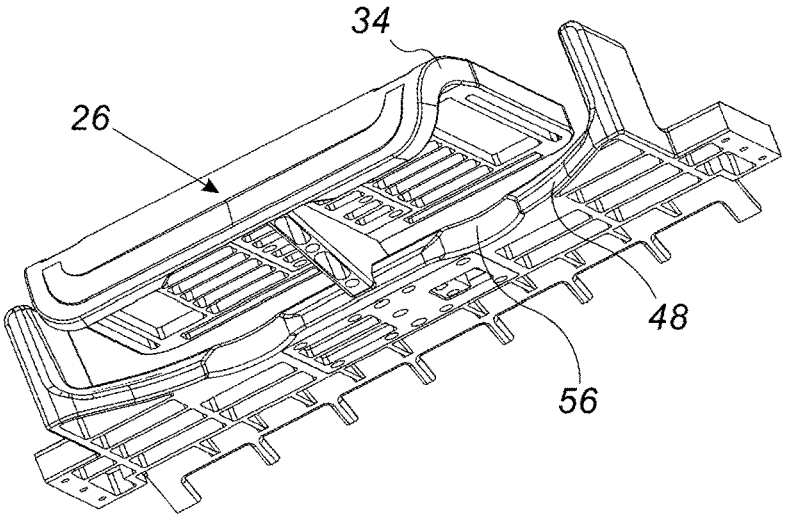
FIG. 7 is a bottom isometric view of a second embodiment of the width folder.
Figure 8:
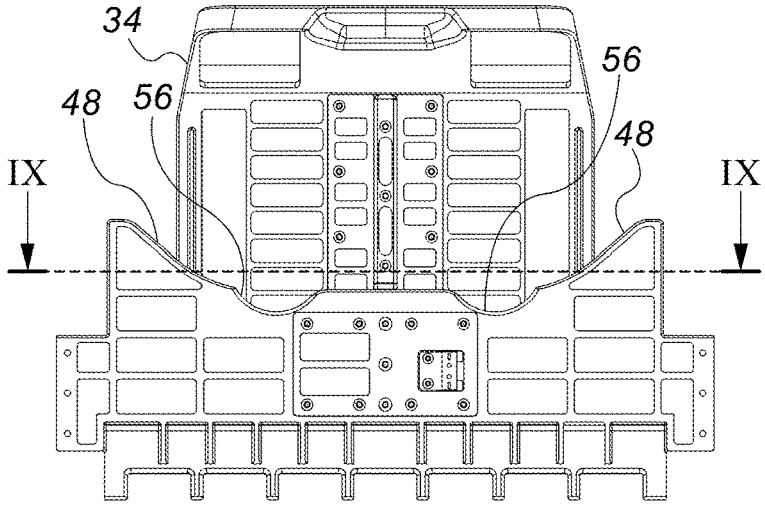
FIG. 8 is a plan bottom view of the width folder of FIG. 7.
Figure 9:
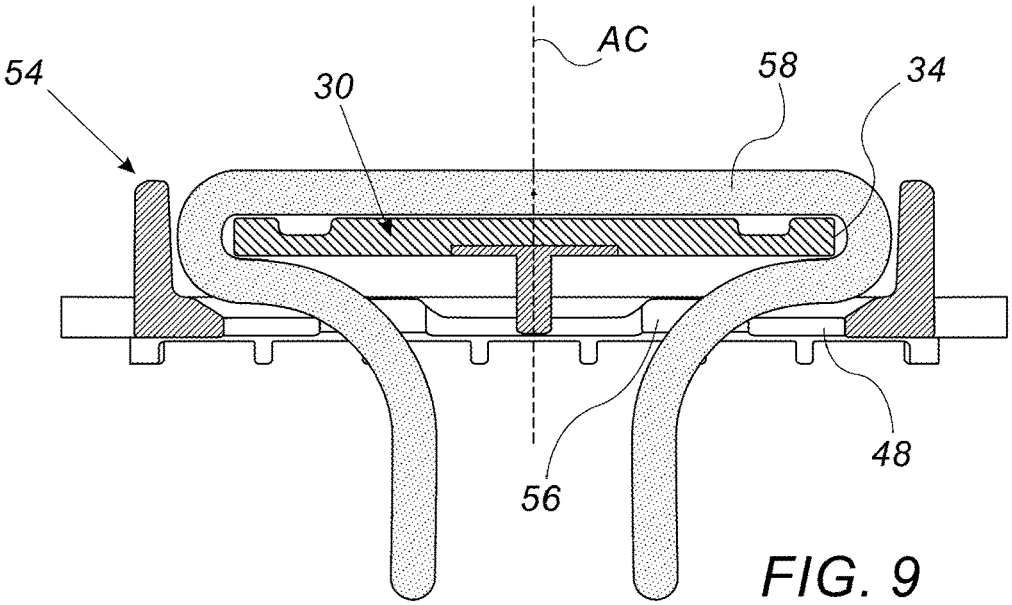
FIG. 9 is a cross-sectional view of the width folder of FIG. 7 taken along line IX-IX of FIG. 8 showing a schematic article of laundry being folded while each of its long extremities is being folded a second fold at, and by, a specialized folding edge recess.

A second embodiment of the width folder 20 is shown in FIGS. 7-9. Each second folding edge 48 can include a folding edge recess 56 therealong. The folding edge recesses 56 are configured to assist, an/or convey article fabric to improve and preferably ensure, locating the fold and formation of a fold, especially in long portions of articles 58, such as long sleeves. This is illustrated in FIG. 9. The folding edge recesses 56 can also enable a more predictable fold as the article 58 is urged inwards in the width direction WD by the second folding edges 48. The folding edge recesses 56 can also improve fold consistency and repeatability.

According to the subject matter of the present application, a method of width folding articles 58 via the width folder 20 includes the following steps:

a. providing the width folder 20;

b. Pulling the article 58 on top of the male member 26 in the motion direction MD while excess extremities of the article 58 hang respectively over the first folding edges 34, until two folds are created, one on each side of the article 58; and c. pulling the article 58 further inwards while the excess extremities of the article 58 climb on the folding protrusions 54 and urged inwardly in the width direction WD.

The invention claimed is:

1. A width-folding system, or width folder (20), configured for width-folding an article of laundry (58), and especially excess portions thereof, the width folder (20) comprising male and female members (26, 28) stacked along a vertical direction (VD);

the male member (26) comprising two opposite first folding edges (34) extending at least partially along a laundry article motion direction (MD) perpendicular to the vertical direction (VD) and comprising opposite male top and bottom surfaces (30, 32) each extending between the first folding edges (34); and the female member (28) being located at least partially beneath the male member (26) and comprising two opposite second folding edges (48) converging inwards along the motion direction (MD); the female member (28) further comprising opposite female top and bottom surfaces (42, 44); in a plan view of the width folder (20) along the vertical direction (VD), each second folding edge (48) intersecting a respective adjacent first folding edge (34);

wherein the female member (28) further comprises opposite folding protrusions (54) which extend outwardly therefrom in a direction away from the female top surface (42) and configured to urge inwards, in the width-direction (WD), excess fabric, or extremities, of the laundry article (58) while it proceeds across the male top surface (30); and wherein the male member (26) further comprises a sloping portion extending downwards, beneath the male top surface (30), along the vertical direction (VD), and in a direction opposite the motion direction (MD).

2. The width folder (20) according to claim 1, wherein the female and male members are permanently and rigidly connected to one another.

3. The width folder (20) according to claim 1, wherein the folding protrusions (54) have a rectilinear blade shape in a view along a width direction (WD) which is perpendicular to the motion direction (MD) and the vertical direction (VD).

4. The width folder (20) according to claim 1, wherein the folding protrusions (54) have a thin shape which extends parallel to the vertical direction (VD).

5. The width folder (20) according to claim 1, wherein the folding protrusions (54) extend beyond the male member in the vertical direction (VD) away from the female top surface (42).

6. The width folder (20) according to claim 1, wherein the folding protrusions (54) extend from the female top surface (42).

7. The width folder (20) according to claim 1, wherein each folding protrusion (54) extends from a respective end of the respective second folding edges (48).

8. The width folder (20) according to claim 1, wherein the width-folder comprises exactly two folding protrusions (54).

9. The width folder (20) according to claim 1, wherein the male top surface (30) comprises two opposite parallel grooves (24) which open out thereto.

10. The width folder (20) according to claim 1, wherein in a top view of the width folder (20), tangent lines to each of the first folding edges (34) converge in a direction opposite the motion direction (MD).

11. The width folder (20) according to claim 1, wherein in a bottom view of the width folder (20), tangent lines to each of the second folding edges (48) converge in the motion direction (MD).

12. The width folder (20) according to claim 1, wherein each second folding edge (48) has a folding edge recess (56)

which is configured to improve fold formation, locating the fold and for repeatability for long extremities, and especially long sleeves.

13. A method of width-folding excess portions of an article of laundry (58) comprising the following steps:

a. providing the width folder (20) according to claim 1;

b. pulling the article (58) across male top surface (30) in the motion direction (MD) while excess extremities of the article (58) hang respectively over the first folding edges (34);

c. pulling the article (58) further while the excess extremities of the article (58) climb on the folding protrusions (54) and urged inwardly in the width direction (WD).

* * * * *